US005874971A

United States Patent [19]

Nishioka et al.

[11] Patent Number: 5,874,971

[45] Date of Patent: Feb. 23, 1999

[54] INK JET HEAD CONNECTION UNIT, AN INK JET CARTRIDGE, AND AN ASSEMBLY METHOD THEREOF

[75] Inventors: Atsushi Nishioka; Yukihiro Hanaoka; Kazuhiko Sato; Tsutomu Yamazaki, all of Suwa, Japan

[73] Assignee: Seiko Epson Corporation, Tokyo, Japan

[21] Appl. No.: 700,900

[22] Filed: Aug. 21, 1996

[30] Foreign Application Priority Data

Aug. 22, 1995 [JP] Japan ..... 7-213838
Jul. 11, 1996 [JP] Japan ..... 8-182517

[51] Int. Cl.[6] ..... B41J 2/45

[52] U.S. Cl. ..... 347/20; 347/87

[58] Field of Search ..... 347/65, 54, 86, 347/87, 56, 68, 20

[56] References Cited

U.S. PATENT DOCUMENTS

| | | | |
|---|---|---|---|
| 4,500,895 | 2/1985 | Buck et al. | 347/87 |
| 5,477,247 | 12/1995 | Kanegae | 347/20 |
| 5,581,288 | 12/1996 | Shimizu et al. | 347/87 |

FOREIGN PATENT DOCUMENTS

| | | |
|---|---|---|
| 0 419 193 | 3/1991 | European Pat. Off. . |
| 0 565 334 | 10/1993 | European Pat. Off. . |
| 585 615 A2 | 3/1994 | European Pat. Off. . |
| 585 615 A3 | 3/1994 | European Pat. Off. . |
| 0 709 201 | 5/1996 | European Pat. Off. . |
| 55-109668 | 9/1980 | Japan . |
| 60-183157 | 9/1985 | Japan . |
| 60183157 | 9/1985 | Japan . |
| 62-82051 | 4/1987 | Japan . |
| 62-124955 | 6/1987 | Japan . |
| 4-107043 | 9/1992 | Japan . |
| 6-210869 | 8/1994 | Japan . |
| 7-195704 | 8/1995 | Japan . |
| 94 16897 | 8/1994 | WIPO . |

*Primary Examiner*—N. Le
*Assistant Examiner*—Anh T. N. Vo
*Attorney, Agent, or Firm*—W. Glen Johnson; Eric B. Janofsky

[57] ABSTRACT

To provide a highly reliable and easy-to-manufacture ink jet head connection unit, in which ink supply paths are formed by gluing a substrate on which head component is formed to other components, that is free of ink ejection failure and ink leakage. A head component and case component 240 equipped with opening 241 on the bottom of which supply port 257 for supplying ink to head component 210 and concave area 243 to be filled with an adhesive are formed, are provided. Space 248 to be filled with an adhesive for joining head component 210 and case component 240 when case component 240 and head component 210 are coupled, is formed inside the joined case.

11 Claims, 10 Drawing Sheets

INK JET HEAD CONNECTION UNIT, AN INK JET CARTRIDGE, AND AN ASSEMBLY METHOD THEREOF

BACKGROUND OF THE INVENTION

1. Field of the Invention

The invention relates to an ink jet printer for printing data on a recording medium by ejecting ink from ink jet heads, and more particularly to an ink jet head connection unit for connecting ink supply paths for supplying ink to the ink jet heads.

2. Description of the Related Art

A conventional method of connecting an ink jet head to an ink supply path has been to use an adhesive to join the substrate constituting the ink jet head and the component constituting the supply path, thereby forming an ink supply path and supplying ink to the ink jet head.

For example, U. S. Pat. No. 4,500,895 discloses an example of forming an ink supply path that supplies ink to an ejection mechanism (mechanism for providing ejection force to ink) by using an adhesive to join a glass or ceramic substrate possessing an jet feed hole to a recess of a plastic backing plate possessing a groove and a feed hole.

Multiple thin-film thermal jetting resistors are formed on the surface of this substrate, and the jet feed hole to a thermal jetting resistor area is formed through the substrate. A groove is provided in the recess of the backing plate, in the position corresponding to the jet feed hole of the substrate. Furthermore, the feed hole is also provided in the backing plate to connect the groove to a flexible ink reservoir. A capillary supply path for supplying ink from the ink reservoir to the ink jet resistor area is formed by joining the substrate with the back plate.

However, this conventional method had the problems described below.

It is difficult to evenly apply an appropriate thin coat of adhesive to the substrate and the backing plate used for forming ink jet heads. Especially, if the amount of adhesive is excessive, the adhesive flows into the ink supply path, clogging the capillary supply path and preventing ink supply to the ejection mechanism, and as a result, thus preventing ink droplet ejection. On the other hand, if the amount of adhesive is in sufficient, a gap is created in the junction surface, leaving the potential of ink leakage from the gap.

Furthermore, because the surface on which the adhesive has been applied is exposed during the assembly of the ink jet, foreign materials such as dust may adhere to the adhesion surface, leaving the risk of creating gaps in the junction surface as described above. Moreover, since the substrate on which an ejection mechanism has been formed is adhered to the surface to which the adhesive has been applied, it is difficult to precisely position the substrate against the backing plate for adhesion.

OBJECTS OF THE INVENTION

It is an object of the present invention to overcome the aforementioned problems.

It is another object of the present invention to prevent the problem of an adhesive flowing into the ink path to clog the ink path, causing ink droplet ejection failure by preventing ink supply to the head component.

It is an additional object of the present invention to prevent the problem of ink leakage that will be caused by a joint failure caused by uneven adhesive coating or dust adhesion to the adhesive-coated surface during the assembly process.

It is also an object of the present invention to provide an ink jet head which is extremely easy to assemble because the surfaces for gluing the components that constitute the ink jet head connection unit or the ink jet cartridge are not exposed during the assembly process.

It is further aspect of the present invention to inexpensively create an ink jet head connection unit that is highly reliable on the whole and easy to connect, and an ink jet cartridge equipped with such an unit.

SUMMARY OF THE INVENTION

The present invention has been developed in order to solve the above-mentioned problems. In accordance with a first aspect of the present invention, an ink jet head connection unit connects an ink jet head for ejecting ink droplets according to the recording content with an ink supply path for supplying ink to the ink jet head. A head component is provided with a first surface on which a nozzle for ejecting ink droplets have been formed, and with a second surface on which an intake opening for supplying ink to the nozzle has been formed, and a case component on which a supply port for supplying ink to the head component has been formed are provided. A concave area is provided for forming a space between the head component and the case component for injecting an adhesive and a hole leading to the space, for positioning the head component to the case component such that the intake opening and the supply port are connected, are provided on either or both of the head component and the case component.

When the ink jet head connection unit is thus configured, an adhesive can be injected through the hole using a hypodermic needle, for example, while the ink jet is positioned in the case component. In this case, the adhesive first fills the gap intentionally formed between the head component and the case component, and then proceeds to sufficiently fill the gap between the head component and the case component, isolating the ink supply path connecting the head component and the case component from the outside. Since the adhesive is injected into the case from the outside and is not exposed during the assembly process, the assembly becomes extremely simple. The present invention completely eliminates adhesion failure, which has always been a problem during assembly using an adhesive due to dust adhesion.

In accordance with a second aspect of the present invention, an opening is provided in the case component and to form the supply port on the bottom of the opening in the ink jet head connection unit. By matching the second surface of the head component to this opening, the head component is positioned against the case component, and then these components are joined by injecting an adhesive into the space formed between the head component and the case component. Therefore, the case-to-nozzle positioning accuracy is improved compared to a conventional approach.

In accordance with a third embodiment of the present invention, a head component is provided with a first surface on which a nozzle for ejecting ink droplets have been formed, and with a second surface on which an intake opening for supplying ink to the nozzle has been formed. A first case component is provided on which a supply port for supplying ink to the head component has been formed, and a second case component clamps the sides of the head component. A concave area forms a space between the first case component and the second case component for injecting an adhesive and a hole leading to the space, for positioning the head component being clamped by the second case component to the first case component such that the intake opening and the supply port are connected, are provided on either or both of the first case component and the second case component. Because the sides of the head component are clamped by the second case component, the nozzle can be precisely positioned against the case even if the nozzle is installed on the end surface of the substrate on a flattened cube in the head component, as shown in FIG. 5.

In accordance with a fourth aspect of the present invention, an ink jet cartridge contains an ink holding means for holding ink to be supplied to an ink jet head, providing an ink jet cartridge that is easy to assemble.

In accordance with a fifth aspect of the present invention, the post-hardening Young's modulus of the adhesive is preferably at least 1N /$m^2$ and not more than $35.3\times10^5$N/$m^2$.

In general, because the head component requires detailed processing, materials such as glass and silicon are used, and plastic is often used for the case component. Because the thermal expansion coefficients of these materials are different, a change in the ambient temperature causes stress in the junction areas. Therefore, a flexible adhesive that can absorb some of this stress is preferable. That is, an adhesive possessing Young's modulus after hardening of $35.3\times10^5$N/$m^2$ or less should be used. Because the nozzle position may shift if the adhesive is too soft after hardening, the Young's modulus after hardening is preferably at least 1 N/$m^2$.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

First embodiment

The ink jet head connection unit in the first embodiment of the invention will be explained in detail with references to FIGS. 1–6. Although the invention is explained using an ink jet cartridge in this embodiment, the invention is not limited in its application to a cartridge type and can be applied to any ink jet head connection unit that supplies ink to an ink jet head.

Figure 1:
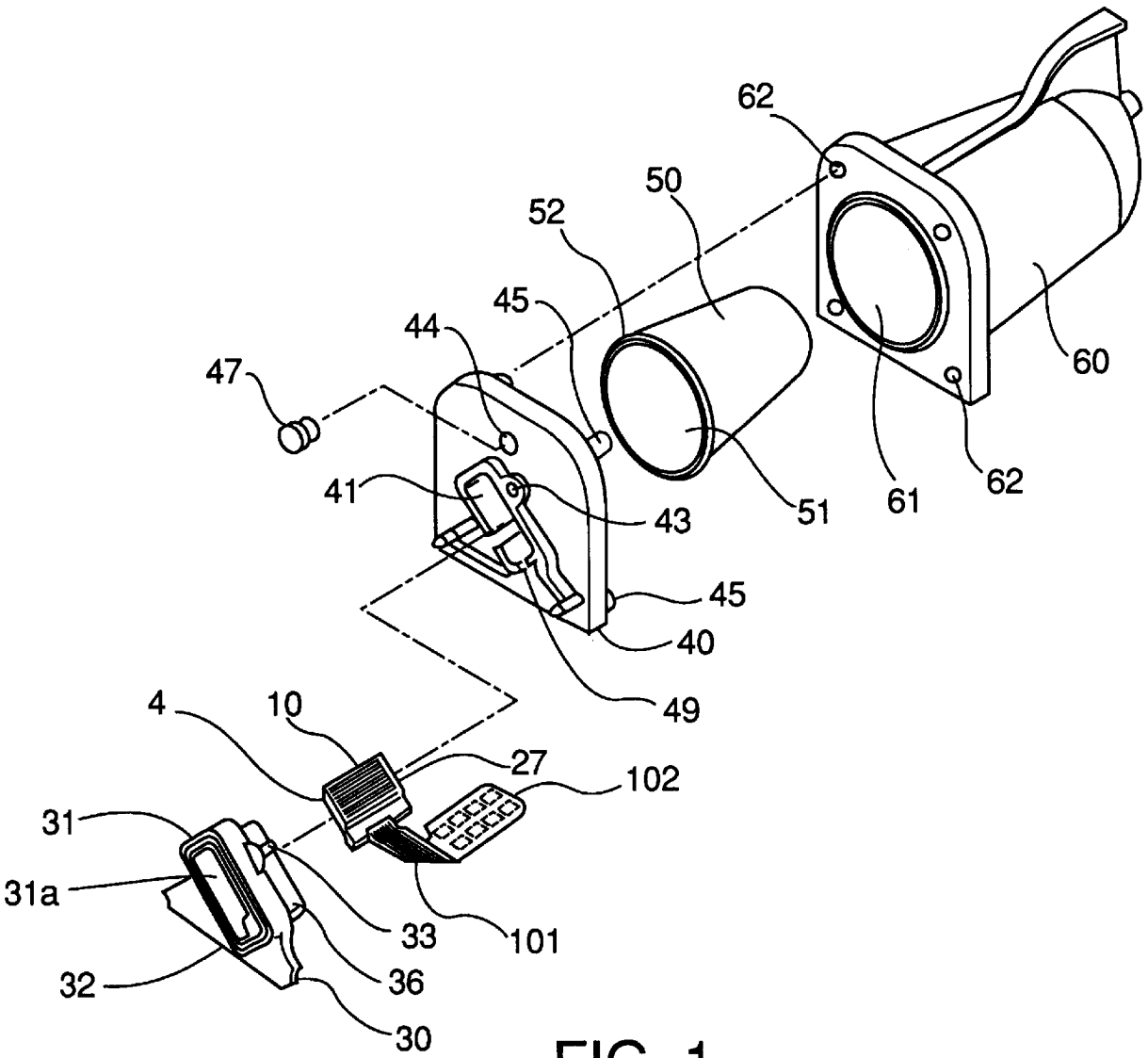
FIG. 1 is an exploded perspective view showing the configuration of the ink jet cartridge in accordance with the first embodiment of the invention.
Figure 2:
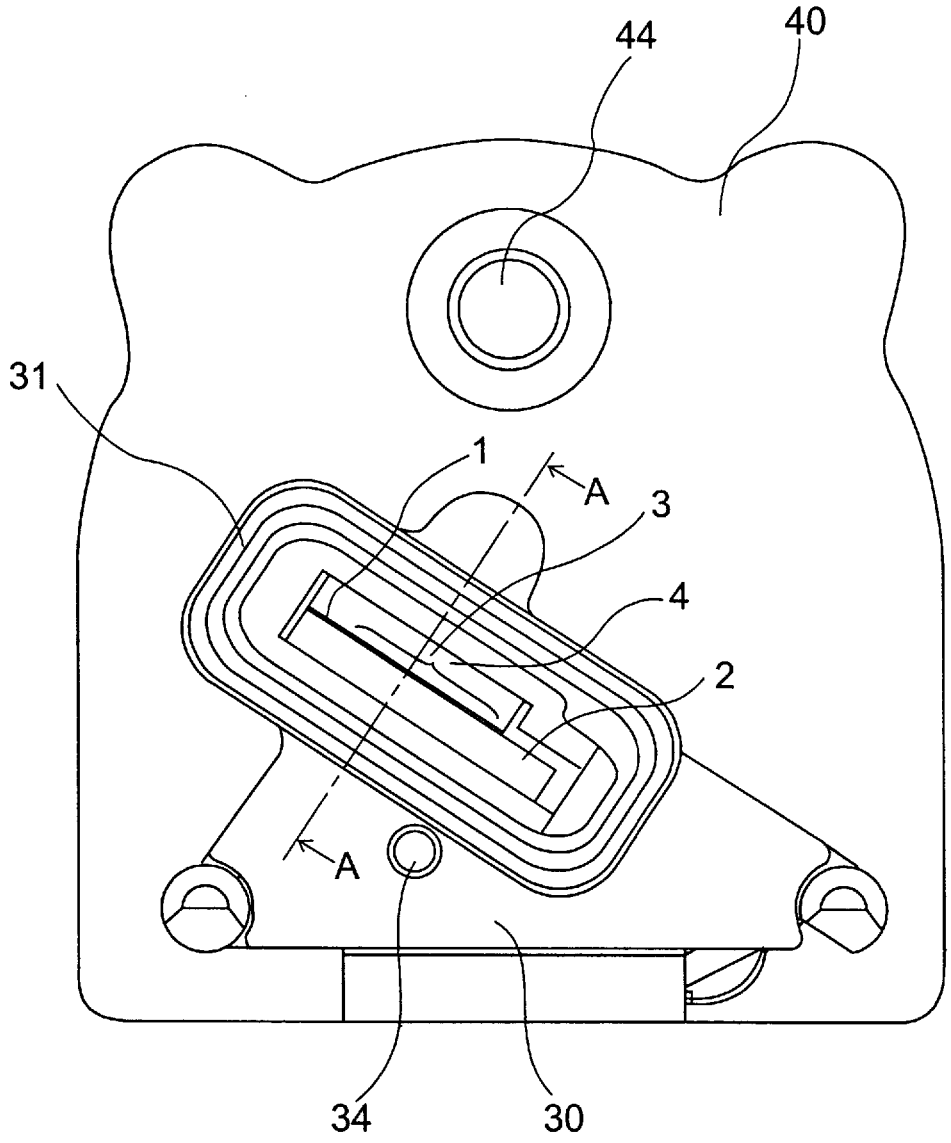
FIG. 2 is a front view of the ink jet cartridge shown in FIG. 1.
Figure 3:
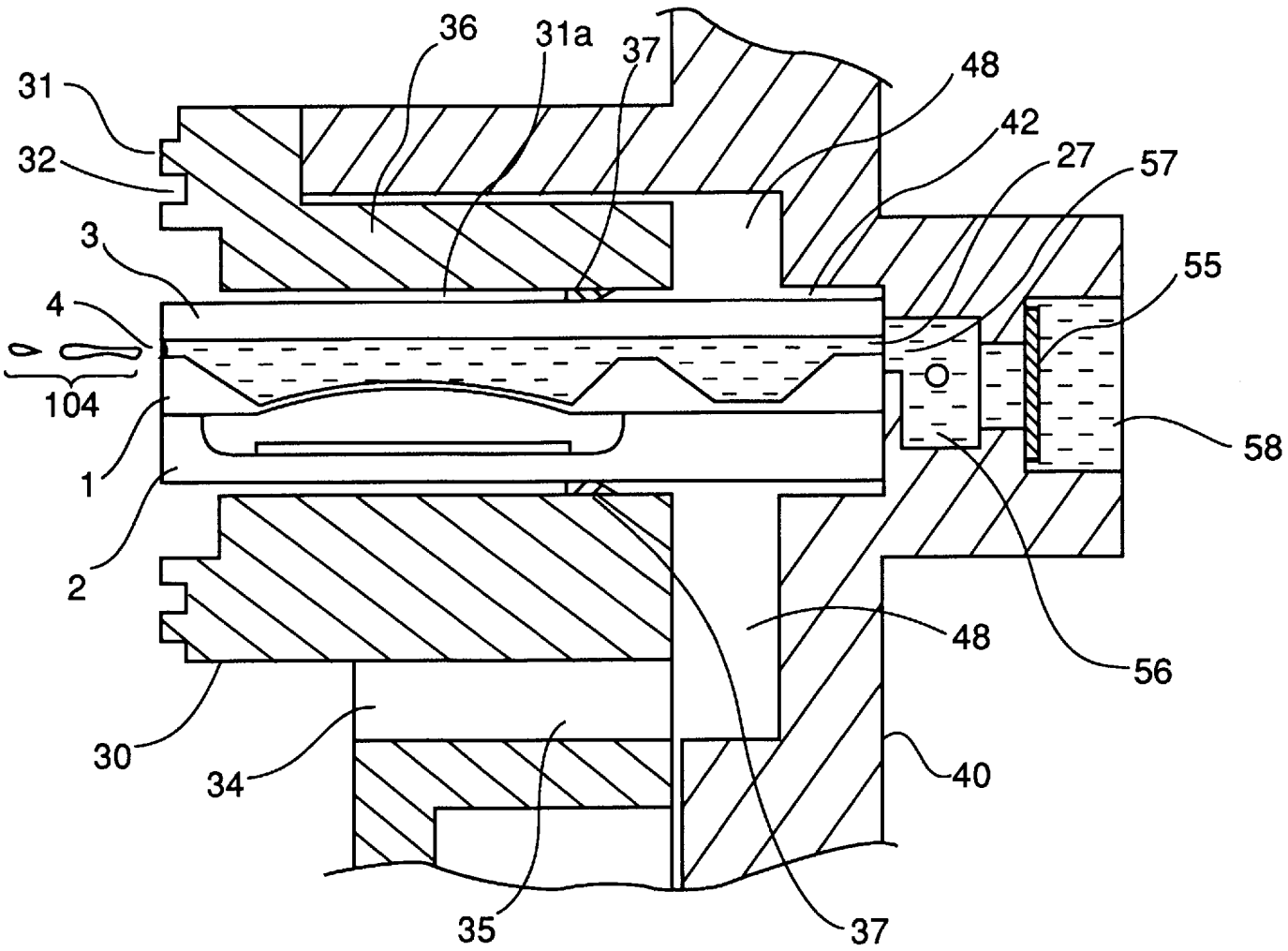
FIG. 3 is a partial cross-sectional view of the ink jet cartridge shown in FIG. 2.

FIG. 1 is an exploded perspective view showing the configuration of the ink jet cartridge in the first embodiment of the present invention, FIG. 2 is the front view of the same ink jet cartridge viewed from the nozzle side, and FIG. 3 is a partial cross-sectional view (along A—A in FIG. 2) of the ink jet head connection unit which is part of the ink jet cartridge.

The ink cartridge comprises an ink jet head connection unit comprising first case component 40 (hereafter referred to as "head case"), second case component 30 (hereafter referred to as "nozzle case 30"), and head component 10; and an ink supply area comprising ink sack 50 and ink case 60.

Nozzle case 30 is made of a resin, such as, AS, ABS, and PSF (polysulfone), and nozzle plate 31 equipped with opening 31*a*, through which nozzle 4 appears when head component 10 is mounted, is provided in the center of nozzle case 30. Ink-stop groove 32 is provided around the nozzle plate 31. This ink-stop groove 32 is designed to use surface tension to retain the ink that is ejected from the nozzle during a priming operation. A priming operation (pressing of ink sack 50 from the outside in order to eject viscous ink or air bubbles) is used when the nozzle is clogged or when air bubbles inside the ink path cause an ejection failure. The ejected ink is retained inside the groove through surface tension. The user performs a priming operation while observing the amount of the ejected ink. That is, the internal area of the groove is preset to enable an appropriate priming operation when the ejected ink fills the groove.

Protruding wall 36 for forming the adhesive groove (to be described below) is formed on the external perimeter of the opening on the back of nozzle case 30. Two pins 33 for connecting the head case are formed on the back of nozzle case 30. Adhesive injection opening 34 is provided on the bottom front of nozzle case 30, and this adhesive injection opening 34 (shown in FIG. 2) is connected to the adhesive groove described below.

Head case 40 is made of a transparent material such as PSF (polysulfone), PC (polycarbonate), and ABS. Linking hole 43 is formed on part of head case 40 that faces nozzle case 30. Pin 33 of nozzle case 30 is pressure-fit into this linking hole 43, linking nozzle case 30 and head case 40. Opening 41, into which protruding wall 36 of the nozzle case is inserted, is formed in the approximate center of head case 40, and opening 42 (shown in FIG. 3) which has the same shape as opening 31*a* of the nozzle case is provided in the center of opening 41. This opening 42 houses the side of ink lead-in opening 27 of head component 10.

Nozzle 4 is formed on one end of head component 10, and ink lead-in opening 27 is formed on the other end. Head FPC (flexible print circuit) 101 for sending signals to head component 10 and the pressure-generating elements positioned in a line inside the head component is inserted into groove 49 of head case 40, terminal area 102 of FPC is fastened to the bottom surface of ink case 60. When an ink cartridge is mounted on the carriage (not shown in the figure), the terminal provided in the carriage and terminal 102 of FPC become electrically connected.

Nozzle case 30 is connected to cover head case 40 in which head component 10 is thus housed. A pair of claws 37 for clamping the ink jet head are provided inside protruding wall 36 of nozzle case 30, and these claws press head component 10 to the bottom of opening 42 of head case 40 during case connection. As a result, the surface of head component 10 on the side of ink lead-in opening 27 makes tight contact with the bottom of the opening of head case 40, and head component 10 is supported inside the case with ink lead-in opening 27 of head component 10 connected to the ink supply port (not shown in the figure) provided on the bottom of the opening of head case 40. Claws 37 also possess a function of positioning head component 10 relative to the case.

As shown in FIG. 3, opening 41 of the head case and protruding wall 36 of the nozzle case form a space (adhesive groove 48) around the entire outside perimeter near ink lead-in opening 27 of head component 10 inside the connected case.

Nozzle case 30 is provided with adhesive injection opening 34 and injection tube 35, and a dispenser provided with a hypodermic needle, for example, is used to inject an adhesive from injection opening 34 through injection tube 35 into adhesive groove 48. In this way, the area around lead-in opening 27 of ink jet head 10 is sealed by the adhesive and hand component 10 is fastened to the case.

Figure 4:
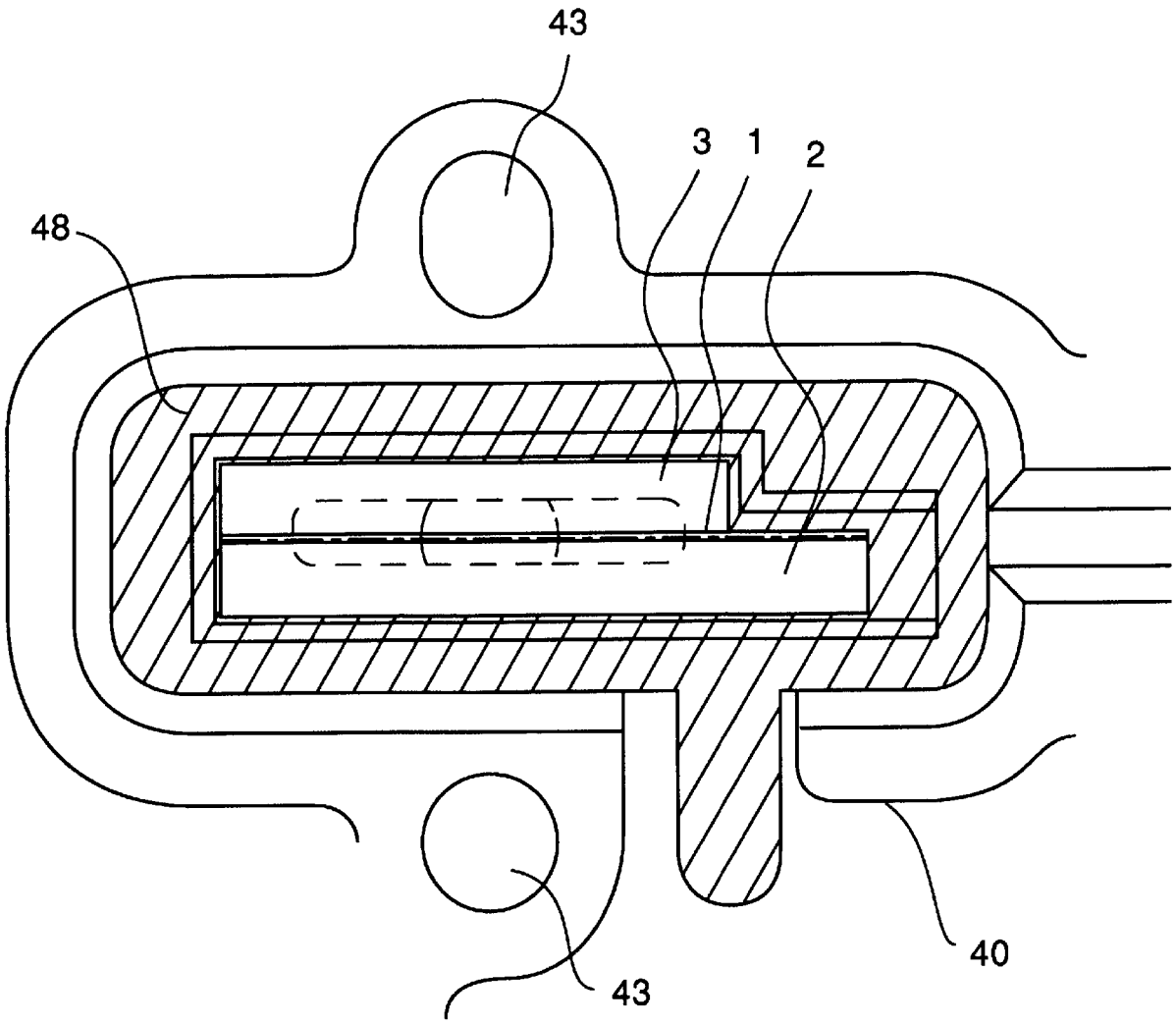
FIG. 4 shows a state in which adhesive groove 48 has been filled with an adhesive in the ink jet cartridge shown in FIG. 1.

FIG. 4 shows the state in which adhesive groove 48 has been filled with an adhesive. The part of adhesive groove 48 that becomes filled with an adhesive is indicated as a shaded area in FIG. 4, and the adhesive is filled to surround head component 10. The adhesive that is injected into adhesive groove 48 is led into the gap between head component 10 and head case 40 by a capillary action and is spread evenly.

However, as explained above, because head component 10 is supported by claws 37 such that the surface of head component 10 on the side of ink lead-in opening 27 makes tight contact with the bottom of opening 42 of head case 40 while ink lead-in opening 27 and ink supply path 57 are connected, the adhesive only seeps into the slight gap created between the two surfaces and does not enter ink lead-in opening 27 or ink supply path 57.

The ink jet head connection unit is thus joined, resulting in complete connection from the ink supply area to the nozzle. In other words, the ink supplied from ink supply tube 58 formed on the back of head case 40 is supplied to lead-in opening 27 of head component 10, via case reservoir 56 of head case 40, without leaking to other areas or being hindered by excess adhesive, and is ejected as ink droplets 104 from nozzle 4 when the pressure-generating means inside the head is activated.

With the ink jet head connection unit of the invention thus configured, simply injecting a specified amount of adhesive through an injection opening provides excellent connection between the head component and the head case that holds the head component and supplies ink. Strong, stable, and leak-free adhesion is achieved as a result. However, the number of openings for injecting the adhesive is not limited to one, and can be set to any appropriate number according to the length, shape, etc. of the adhesive groove.

Turning back to FIG. 1, an ink filling port 44 is provided on the top front of head case 40. Ink filling port 44 is plugged by pressure-fit plug 47 at all time other than when ink is being loaded into the ink cartridge. To prevent foreign matter such as dust from being introduced to the ink when plug 47 is inserted, plug 47 is made of a nylon material, for example. However, a soft resin such as polyimide or a metal ball can also be used. Ink supply tube 58 (shown in FIG. 3) is formed on the back of the head case, and filter 55 (shown in FIG. 3) is heat-welded to its opening. Additionally, multiple pins 45 for connecting the head case to ink case 60 are provided on the back of the head case.

Ink sack 50 is made of butyl rubber, for example, and its tip consists of circular opening 51 as shown in the figure, and packing 52 is provided around opening 51. This packing 52 forms a sealing structure by being clamped between head case 40 and ink case 60.

To prevent the ink from leaking from nozzle 4 of an ink cartridge during a standby state in which no printing is taking place or when the ink cartridge is removed from the printer and left idle, it is necessary to constantly supply (negative) pressure for returning the ink from head component 10 to the ink path formed inside the ink cartridge. In this embodiment, the negative pressure is obtained by the elastic characteristics (shape restoration characteristics) of ink sack 50.

Like head case 40, ink case 60 is made of a transparent material such as PSF (polysulfone), PC (polycarbonate), and ABS. Opening 61 is formed on the side of ink case 60 that faces head case 40, which houses ink sack 50. Linkage hole 62 is also formed, and pin 45 of the head case is pressure-fitted into this hole, linking head case 40 and ink case 60.

An example of the head component applied to the invention is explained in detail below with references to FIGS. 5 and 6.

Figure 5:
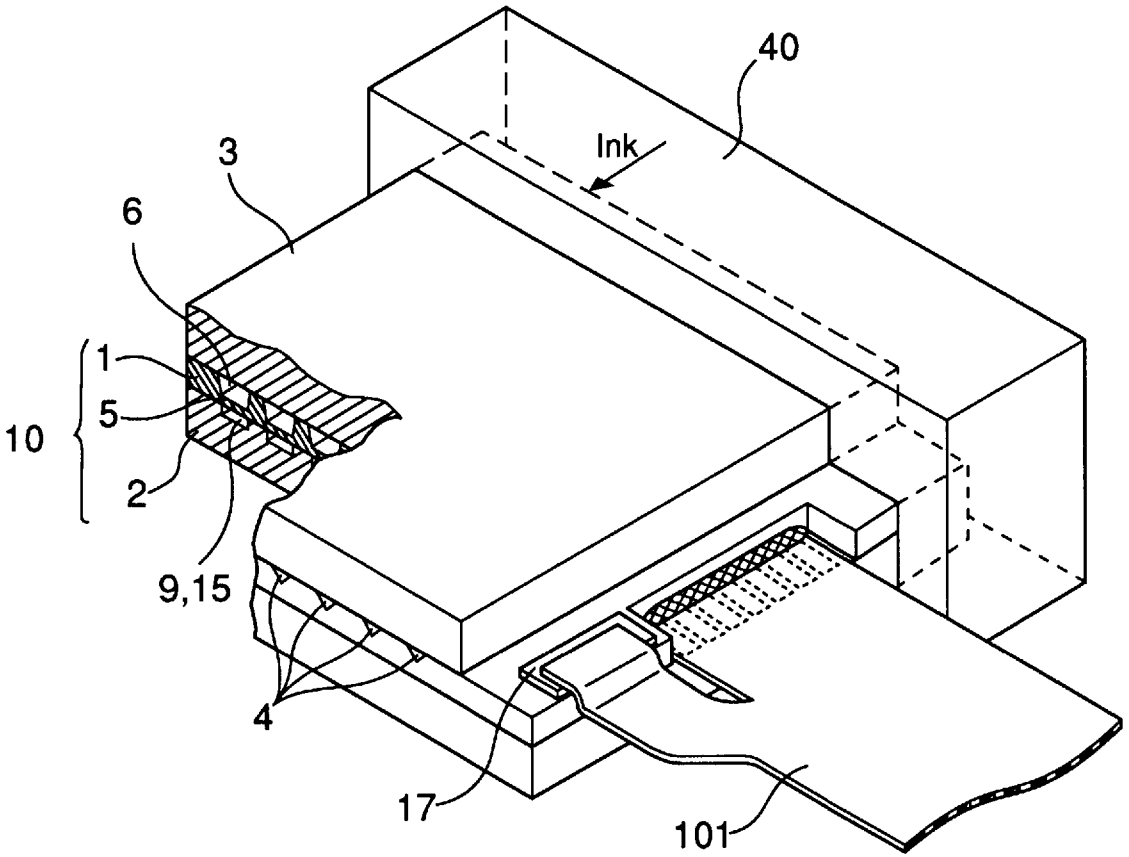
FIG. 5 is an exploded perspective view of the head component in accordance with the first embodiment of the invention.

FIG. 5 is a perspective view of the entire ink jet head that is to be connected to the ink supply means by means of the ink jet head connection unit in this embodiment. FIG. 6 is a cross-sectional view of the ink supply path of the head component.

Head component 10 of this embodiment is made up of three substrates 1, 2, 3 one stacked upon the other and structured as described in detail below.

A first substrate 1 is sandwiched between second and third substrates 2 and 3, and is made from a silicon wafer. Plural nozzles 4 are formed between the first and the third substrate by means of corresponding grooves provided in the top surface of the first substrate 1 such as to extend substantially in parallel at equal intervals from one edge of the substrate. The end of each nozzle opposite the one edge opens into a respective ejection chamber 6.

Plural ejection chambers 6, orifices 7, a common ink cavity 8 and an ink lead-in opening 27 also are formed between the first and the third substrate by means of corresponding groves or recesses provided in the top surface of the first substrate 1.

In the assembled state the groves and recesses constitute ink flow passages such that the ink lead-in opening 27 communicates via the common ink cavity 8 formed by a large recess, orifices 7 formed by narrow grooves and ejection chambers 6 with the nozzles 4.

Electrostatic actuators are formed between the first and the second substrate. The bottom of each ejection chamber 6 comprises a diaphragm 5 formed integrally with the substrate 1. A common electrode 17 is provided on the first substrate 1.

Borosilicate glass, such as Pyrex glass, is used for the second substrate 2 bonded to the bottom surface of first substrate 1. Individual electrodes 21 are formed on the bottom of recess 15 of second substrate 2 by sputtering ITO to a 0.1 $\mu$m thickness in a pattern essentially matching the shape of diaphragms 5. Each of individual electrodes 21 comprises a lead member 22 and a terminal member 23

The recess 15 for accommodating a respective individual electrode 21 is provided on the top surface of the second substrate 2. Bonding the second substrate 2 to the first substrate 1 results in vibration chambers 9 being formed at the positions of recesses 15 between each diaphragm 5 an the corresponding individual electrode 21 opposite to it.

As with second substrate 2, borosilicate glass is used for the third substrate 3 bonded to the top surface of first substrate 1. Bonding third substrate 3 to first substrate 1 completes formation of nozzles 4, ejection chambers 6, orifices 7, ink cavity 8 and ink lead-in opening 27.

Figure 6:
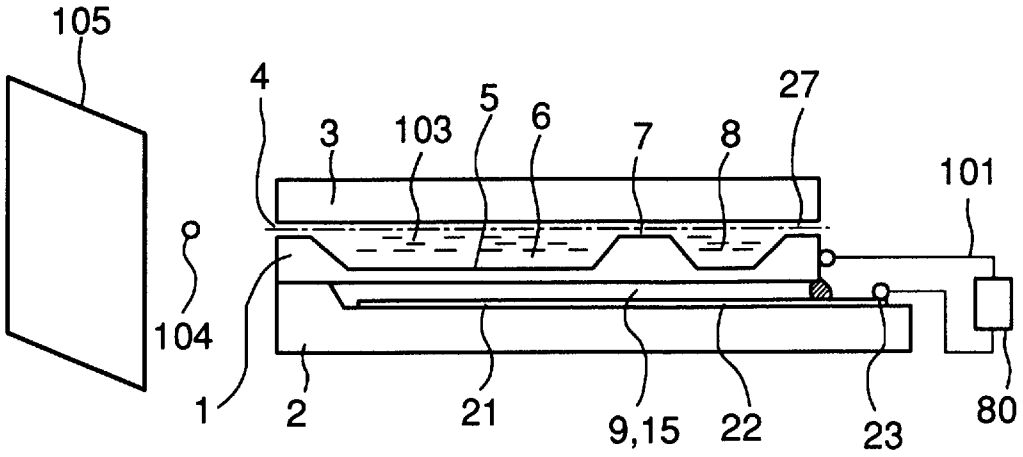
FIG. 6 is a cross-sectional view of the head component shown in FIG. 5.

In head component 10 thus configured and after being assembled as an ink jet cartridge, common electrode 17 and individual electrode 21 are connected to drive circuit 80 via head FPC 101, as shown in FIG. 6. Ink 103 is supplied into substrate 1 via ink lead-in opening 27 and fills reservoir 8, ejection chambers 6, etc.

When voltage is applied between common electrode 17 and individual electrode 21 by drive circuit 80, the electrostatic actuator consisting of diaphragm 5 and individual electrode which face each other at a specified gap, is charged, and the resulting electrostatic force generated distorts diaphragm 5 toward individual electrode 21.

As a result, the pressure inside ejection chamber 6 declines, drawing ink from reservoir 8 into ejection chamber 6. Subsequently, when charging is stopped, abruptly discharging the charge accumulated in the electrostatic actuator, the elastic force of the diaphragm restores diaphragm 5 to its original shape. During this process, the pressure inside ejection chamber 6 rises abruptly, ejecting ink droplets 104 from nozzle 4 onto recording paper 105.

Second embodiment

The ink jet head connection unit in the second embodiment of the invention will be explained in detail with references to FIGS. 7–9.

Figure 7:
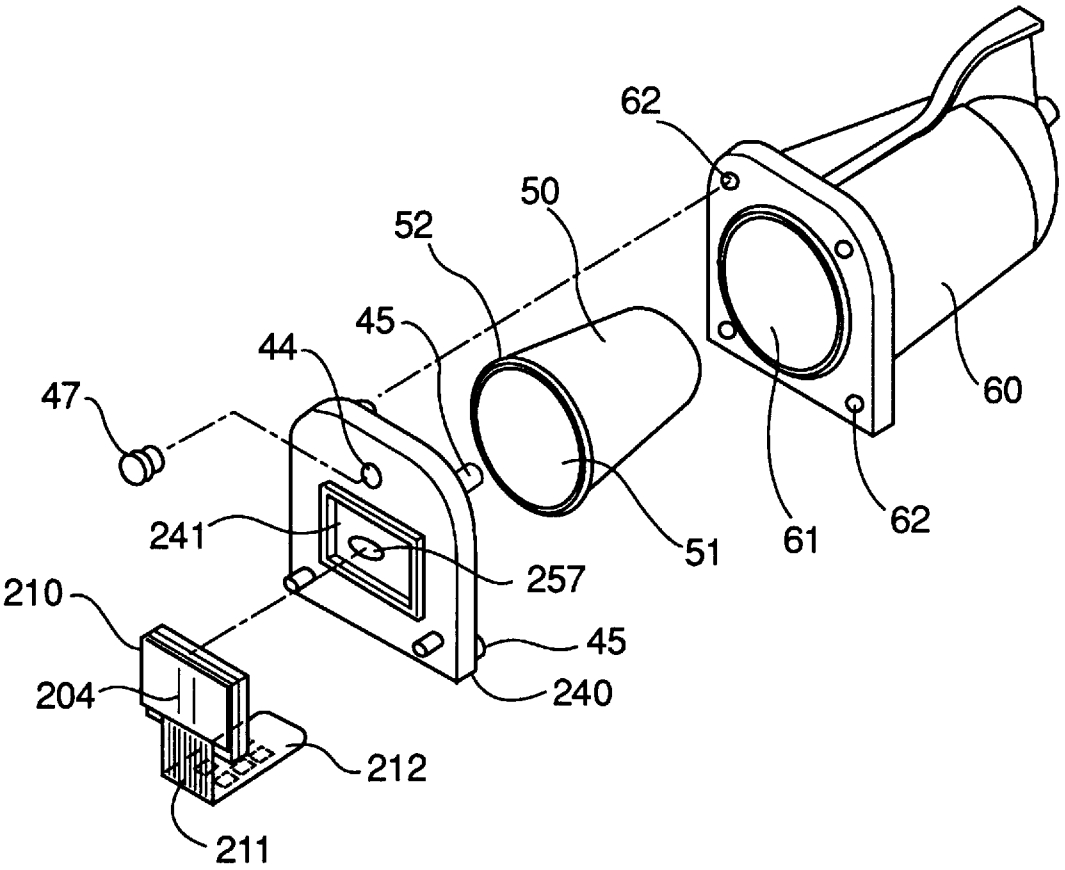
FIG. 7 is an exploded perspective view showing the configuration of a second embodiment of the ink jet cartridge of the present invention.
Figure 8:
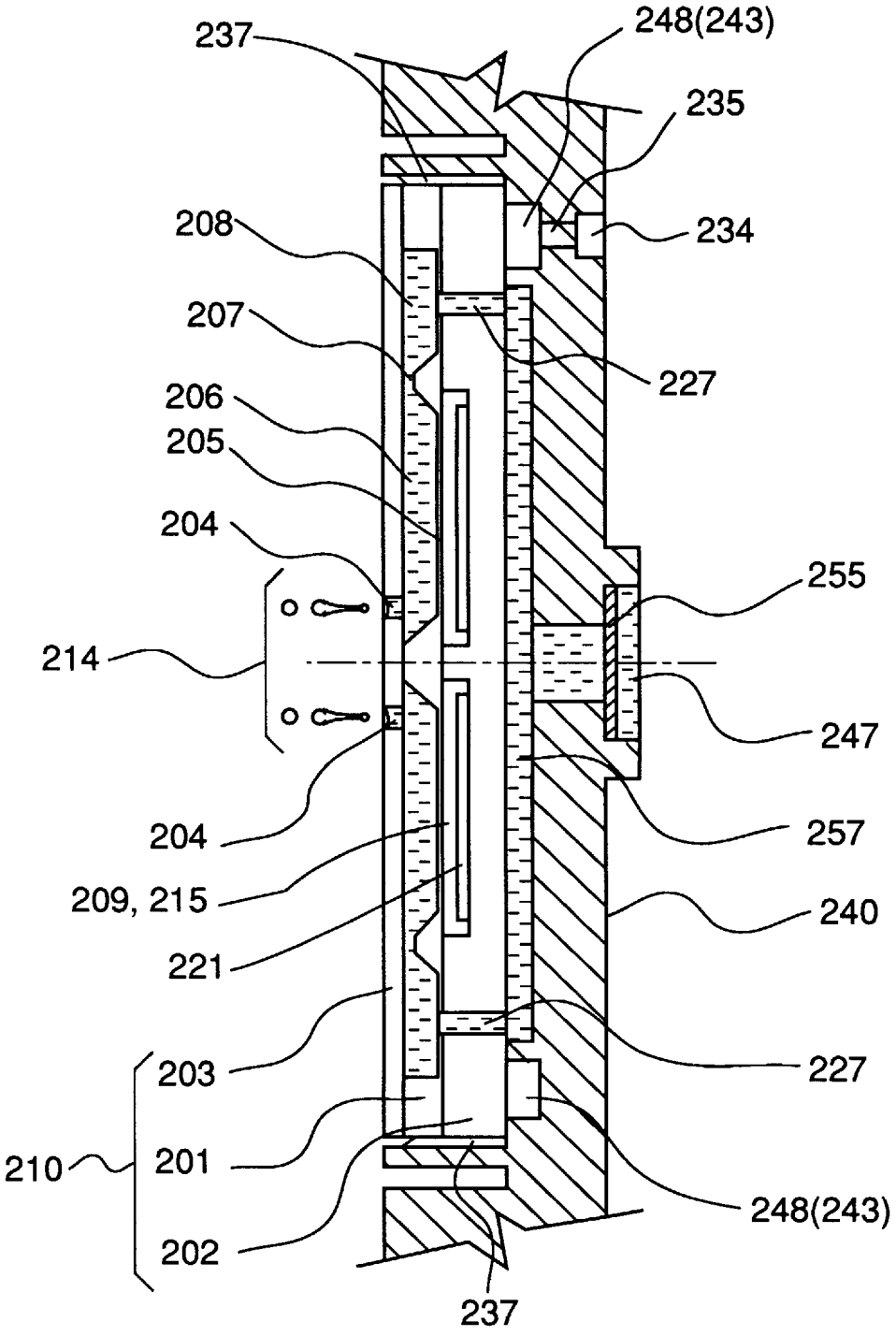
FIG. 8 is a partial cross-sectional view of the ink jet cartridge shown in FIG. 7.

FIG. 7 is an exploded perspective view showing the configuration of the second embodiment of the ink jet cartridge of the invention. FIG. 8 is a partial cross-sectional view of the ink jet head connection unit which is part of the ink jet cartridge.

The ink cartridge comprises an ink jet head connection unit comprising head component (head case) 240 and head component 210; and an ink supply area comprising ink sack 50 and ink case 60.

Head case 240 is made of a transparent material such as PSF (polysulfone), PC (polycarbonate), and ABS. Opening 241 into which a head component is to be inserted is formed in the approximate center of this head case 240. Concave area 243 for forming the space for injecting the adhesive described below and ink supply port 257 for supplying ink to the head component are provided on the bottom of the opening 241. Adhesive injection opening 234 is provided on the back surface of head case 240, and this injection opening 234 is connected to concave area 243 which will be filled with adhesive. Claws 237 for clamping the head component are provided inside opening 241 of head case 240, and these claws position head component 210 against the case during head insertion and supports head component 210 inside the case.

Head component 210 of this embodiment is made up of three substrates 201, 202, 203 one stacked upon the other and structured as described in detail below.

A first substrate 201 is sandwiched between second and third substrates 202 and 203, and is made from a silicon wafer. Plural ejection chambers 206, orifices 207, a common ink cavity 208 are formed between the first and the third substrate by means of corresponding groves or recesses provided in the top surface of the first substrate 201

Electrostatic actuators are formed between the first and the second substrate. The bottom of each ejection chamber 206 comprises a diaphragm 205 formed integrally with the substrate 201. A common electrode (not shown) is provided on the first substrate 201. Borosilicate glass, such as Pyrex glass, is used for the second substrate 202 bonded to the bottom surface of first substrate 201. Individual electrodes 221 are formed on the bottom of recess 215 of second substrate 2 by sputtering ITO. Recess 215 for accommodating a respective individual electrode 221 is provided on the top surface of the second substrate 202. Bonding the second substrate 202 to the first substrate 201 results in vibration chambers 209 being formed at the positions of recesses 215 between each diaphragm 205 an the corresponding individual electrode 221 opposite to it.

As with first substrate 201, silicon wafer is used for the third substrate (nozzle plate) 203 bonded to the top surface of first substrate 201. Plural nozzle holes 204 each corresponding respective ejection chamber 206 are arranged on the first substrate 201. Bonding third substrate 203 to first substrate 201 completes formation of nozzle holes 204, ejection chambers 206, orifices 207 and ink cavity 208. Ink lead-in openings 227 is formed in first and second substrates so as to lead into ink cavity 208. Ink lead-in openings 227 is connected to the ink supply port 257 of the head case 240 in the assemble state.

As explained above, the top surface of head component 210 of this embodiment is provided with nozzle 204, and its bottom surface is provided with ink lead-in opening 227. The second embodiment is suitable to a so-called face-ejection type head component in which nozzles are formed on the top surface of a substrate, and in this aspect is different from the edge-ejection type head component used in the first embodiment in which nozzles are formed on the edge of a substrate.

Terminal area 212 of head FPC 211 for sending signals to head component 210 and to the pressure-generation elements positioned in a line inside the head component is fastened to the bottom surface of ink case 60. Mounting the carriage (not shown in the figure) in the ink cartridge electrically connects the terminal provided in the carriage with terminal 212 of FPC. As shown in FIG. 8, concave area 243 provided on the bottom of opening 241 of head case 240 and the bottom surface of head component 210 form a band-shaped space (adhesive groove 248) around the entire outside perimeter near ink supply port 257 of head case 240, inside the case in which the head has been inserted.

Head case 240 is provided with adhesive injection opening 234 and injection tube 235, and a dispenser provided with a hypodermic needle, for example, is used to inject an adhesive from injection opening 234 through injection tube 235 into adhesive groove 248. In this way, the area around ink supply port 257 of head case 240 is sealed by the adhesive and head component 210 is fastened to the case.

Figure 9:
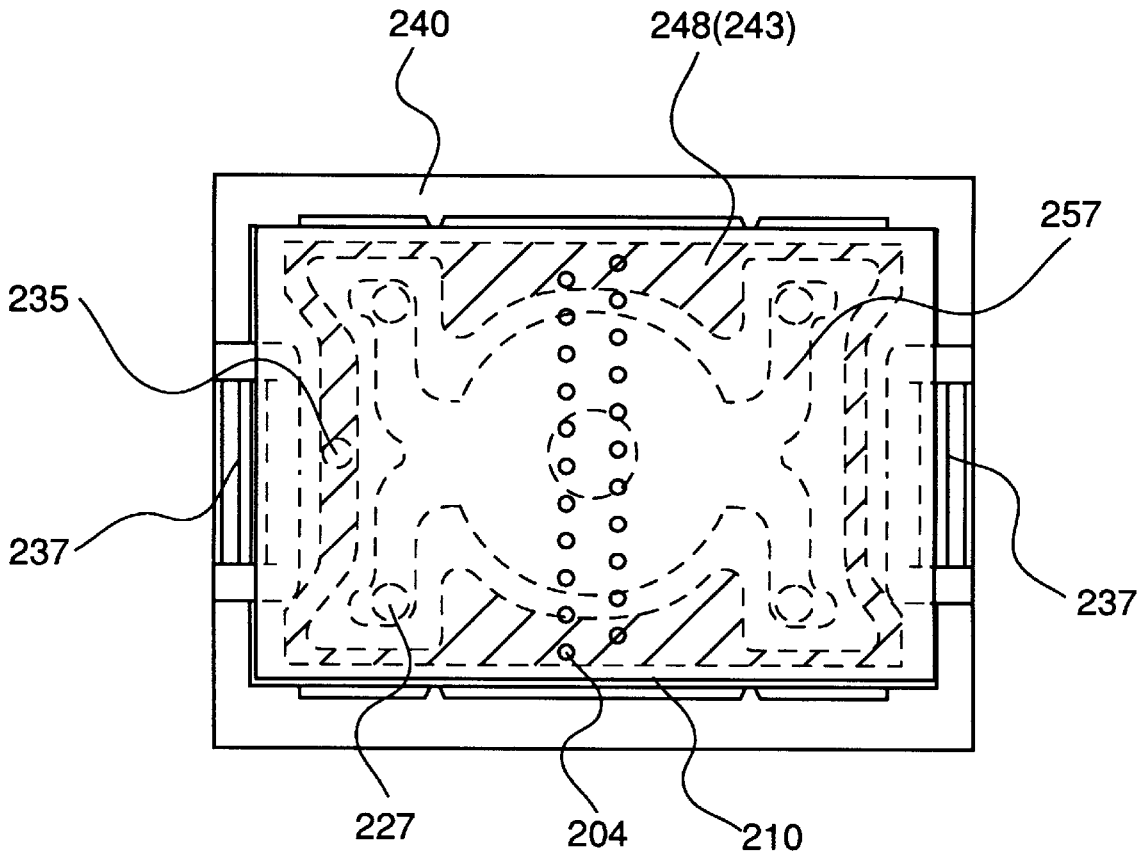
FIG. 9 shows a state in which adhesive groove 248 has been filled with an adhesive in the ink jet cartridge shown in FIG. 7.

FIG. 9 is a top view from the direction of the nozzle, showing the state in which adhesive groove 248 has been filled with an adhesive.

The area of adhesive groove 248 that becomes filled with an adhesive is indicated as a shaded area in FIG. 9, and the adhesive is filled to surround the external perimeter of ink supply port 257 of head case 240. The adhesive that is injected into adhesive groove 248 is led into the gap between head component 210 and head case 240 by a capillary action and is spread evenly.

By using a jig (not shown in the figure) to apply appropriate pressure to the surface of the head where nozzle 204 has been formed, during head insertion or adhesive injection, it is possible to tightly connect the surface of the head on the side of ink lead-in opening 227 to the bottom surface of case opening 241, and thus preventing the adhesive from entering lead-in opening 227 or ink supply port 257.

The ink jet head connection unit is thus joined, resulting in complete connection from the ink supply area to the nozzle. In other words, the ink supplied from ink supply tube 247 formed on the back of head case 240 is supplied to lead-in opening 227 of head component 210, passing filter 255 and via ink supply port 257 and without leaking to other areas or being hindered by excess adhesive, and is ejected as ink droplets 214 from nozzle 204 when pressure-generating means 205 inside the head is activated.

With the ink jet head connection unit of the invention thus configured, simply injecting a specified amount of adhesive through several injection openings (only one is used in this embodiment) provides excellent connection between the head component and the head case that holds the head component and supplies ink. Strong, stable, and leak-free adhesion is achieved as a result.

Third embodiment

Figure 10:
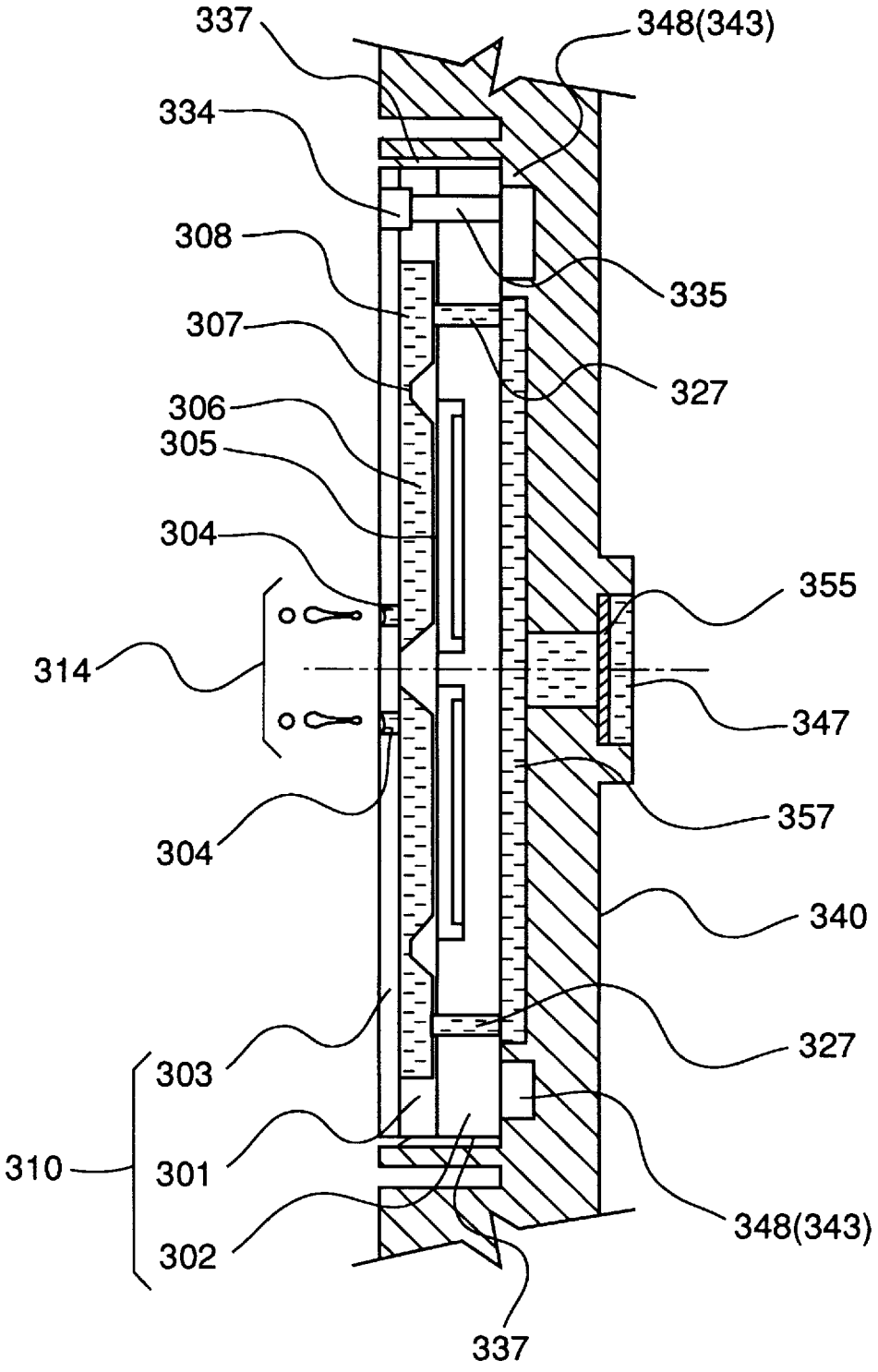
FIG. 10 is a cross-sectional view showing a third embodiment of the ink jet cartridge of the present invention.

FIG. 10 is a cross-sectional view showing the third embodiment of the ink jet head connection unit of the invention. Like the ink jet head connection unit shown in FIGS. 7–9, the ink jet head connection unit of this embodiment is applied to a face-ejection type head component, except that the adhesive injection opening is provided on the head component side.

As in the second embodiment, head component 310 of this embodiment is made up of three substrates 301, 302, 303 one stacked upon the other.

Adhesive injection opening 334 and injection tube 335 are provided near the edge of head component 310. When head component 310 is inserted into the opening in head case 340, groove 348 is formed by concave area 343 provided in head case 340, which becomes connected to adhesive injection opening 334 and injection tube 335.

A dispenser provided with a hypodermic needle, for example, is used to inject an adhesive from adhesive injection opening 334 through injection tube 335 into adhesive groove 348. In this way, the area around ink supply port 357 of head case 340 is sealed by the adhesive and head component 310 is fastened to the case.

The ink jet head connection unit is thus joined, resulting in complete connection from ink supply area 347 to nozzle 304. Note that other structures are identical to those in the second embodiment and thus their explanations are omitted here.

In both the second and the third embodiments of the ink cartridge of the invention shown in FIGS. 7–10, the concave area for forming the adhesive groove is provided on the bottom of the opening in the case component. However, the location of the concave area is not limited to the case component, and can be provided, for example, on the surface of the head component on which the ink lead-in opening is formed.

Furthermore, in the first through the third embodiments, an electrostatic actuator, which is a type of electro-mechanical conversion means for ejecting ink droplets by converting electrical signals into diaphragm vibration, is shown as an example of the pressure-generation means for ejecting ink droplets. However, the pressure-generation for ejecting ink droplets is not limited to such an electrostatic actuator. For example, a piezoelectric element can be used for the electro-mechanical conversion means of the pressure-generation means, or a so-called electro-thermal conversion element can be used that supplies heat to ink and ejects ink droplets using the air bubbles generated in the ink.

Preferred Adhesive Characteristics

The following section describes the preferred characteristics and linear expansion coefficients of the materials for use in the ink jet head connection unit of the invention.

| (1) Materials for the head case component | |
|---|---|
| Material name | Linear expansion coefficients (/°C.) |
| PSF (polysulfone) | $5.5 \times 10^{-5}$ |
| ABS | $8.0 \times 10^{-5}$ |
| (2) Materials for the head component | |
| Material name | Linear expansion coefficients (/°C.) |
| Borosilicate glass | $3.25 \times 10^{-6}$ |
| Si (silicon) | $2.33 \times 10^{-6}$ |

When the head component and the head case are joined, adhesive will protrude to the area that directly contacts ink. The adhesive to be used in such locations that come into direct contact with ink must possess excellent ink resistance and gas impermeability. Thermo-hardening epoxy adhesives can generally satisfy these characteristics requirements.

However, if a material low in stress resistance, such as borosilicate glass, is used for the component that constitutes the head component, the head is subjected to stress due to the difference in thermal expansion at the junction with the case component, cracks may result in the component that constitute the head component.

If an adhesive possessing a low Young's modulus after hardening, such as a modified silicone resin, is used in addition to the above material, the above-mentioned crack phenomenon does not occur.

This is because the soft adhesive reduces the stress caused by the difference in thermal expansion of the head component and head case, preventing cracks. Detailed experiments have demonstrated that adhesives possessing Young's modulus after hardening of $35.3\times10^5 N/m^2$ ($36.0\ kgf/mm^2$) or less prevent cracks from occurring in a head component using borosilicate glass. If the adhesive is too soft after hardening, it may cause the nozzle to shift after assembly, and thus Young's modulus after hardening is preferably at least $1N/m^2$.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet head connection unit comprising:

a head component comprising a first surface having a nozzle for ejecting ink droplets, and a second surface having an intake opening for supplying ink to said nozzle;

a case component secured to said head component comprising an ink supply port;

positioning member that positions said head component relative to said case component so as to align said intake opening with said supply port when said case component is secured to said head component;

a concave area formed in at least one of two opposing surfaces of said head component and said case component so as to create a space therebetween, wherein at least one of said intake opening and said supply port is surrounded by said space; and an adhesive injection opening in communication with said space which is disposed in at least one of said head component and said case component, wherein an adhesive is injectable in said adhesive opening for accommodation in said space, wherein said head component is secured to the case component by the adhesive accommodated in said space.

2. An ink jet head connection unit according to claim 1, wherein said opening is provided in said case component and comprises a top and a bottom portion, and wherein said supply port is provided on the bottom portion of said opening.

3. An ink jet head connection unit according to claim 1, wherein Young's modulus after hardening of the adhesive accommodated in said space is between $1N/m^2$ and $35.3\times 10^5 N/m^2$.

4. An ink jet head connection unit according to claim 1, wherein said head component comprises a side, and wherein said case component comprises at least one claw for securing the side of said head component.

5. An ink jet head connection unit according to claim 2, wherein a size of said opening in said case component is approximately a size of the second surface of said head component.

6. An ink jet head connection unit comprising:

a head component comprising on a first side, a first surface having a nozzle for ejecting ink droplets, and on a second side, a second surface having an intake opening for supplying ink to said nozzle;

a first case component secured to the second side of said head component comprising a supply port;

a second case component secured to the first side of said head component;

positioning member that positions said head component relative to said first case component so as to align said intake opening with said supply port when said first case component is secured to said head component;

a concave area formed in at least one of two opposing surfaces of said head component and said first case component so as to create a space therebetween, wherein at least one of said intake opening and said supply port is surrounded by said space; and an adhesive injection opening in communication with said space which is disposed in at least one of said head component and said case component, wherein an adhesive is injectable in said adhesive opening for accommodation in said space, wherein said head component is secured to said first case component by the adhesive accommodated in said space.

7. An ink jet head connection unit according to claim 6, wherein Young's modulus after hardening of the adhesive accommodated in said space is between $1N/m^2$ and $35.3\times 10^5 N/m^2$.

8. An ink jet head connection unit according to claim 6, wherein said second case component comprises at least one claw for securing the second side of said head component.

9. An ink jet head connection unit according to claim 6, wherein a size of said opening in said first case component is approximately a size of the second surface of said head component.

10. An ink jet cartridge comprising:

a reservoir for accommodating ink; and an ink jet head connection unit comprising a head component comprising a first surface having a nozzle for ejecting ink droplets, and a second surface having an intake opening for supplying the ink to said nozzle;

a case component secured to said head component comprising an ink supply port;

positioning member that positions said head component relative to said case component so as to align said intake opening with said supply port when said case component is secured to said head component, a concave area formed in at least one of two opposing surfaces of said head component and said case component so as to create a space therebetween, wherein at least one of said intake opening and said supply port is surrounded by said space; and an adhesive injection opening in communication with said space which is disposed in at least one of said head component and said case component, wherein an adhesive is injectable in said adhesive opening for accommodation in said space, wherein said head component is secured to the case component by the adhesive accommodated in said space.

11. An ink jet cartridge comprising:

a reservoir for accommodating ink; and an ink jet head connection unit comprising:

a head component comprising on a first side, a first surface having a nozzle for ejecting ink droplets, and on a second side, a second surface having an intake opening for supplying the ink to said nozzle;

a first case component secured to the second side of said head component comprising a supply port;

a second case component secured to the first side of said head component;

positioning member that positions said head component relative to said first case component so as to align said intake opening with said supply port when said first case component is secured to said head component, a concave area formed in at least one of two opposing surfaces of said head component and said first case component so as to create a space therebetween wherein at least one of said intake opening and said supply port is surrounded by said space; and an adhesive injection opening in communication with said space which is disposed in at least one of said head component and said case component, wherein an adhesive is injectable in said adhesive opening for accommodation in said space wherein said head component is secured to said first case component by the adhesive accommodated in said space.

* * * * *